US007859371B2

(12) United States Patent
Takano

(10) Patent No.: US 7,859,371 B2
(45) Date of Patent: Dec. 28, 2010

(54) ELECTROMAGNETIC RELAY

(75) Inventor: Satoshi Takano, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 226 days.

(21) Appl. No.: 12/078,043

(22) Filed: Mar. 26, 2008

(65) Prior Publication Data

US 2008/0238591 A1 Oct. 2, 2008

(30) Foreign Application Priority Data

Mar. 26, 2007 (JP) ..... 2007-078940

(51) Int. Cl.
*H01H 51/22* (2006.01)

(52) U.S. Cl. ..... 335/78; 335/128; 335/80

(58) Field of Classification Search ..... 335/78–86, 335/129–131
See application file for complete search history.

(56) References Cited

U.S. PATENT DOCUMENTS 4,761,627 A * 8/1988 Bell ..... 335/128
5,204,647 A * 4/1993 Mitsuki et al. ..... 335/80
5,864,270 A * 1/1999 Hoffman ..... 335/78
6,914,503 B2 * 7/2005 Saruwatari et al. ..... 335/78
7,205,870 B2 * 4/2007 Sanada et al. ..... 335/78
2005/0264387 A1 * 12/2005 Bergh et al. ..... 335/130

FOREIGN PATENT DOCUMENTS

| | | |
|---|---|---|
| JP | 2001-216880 | 8/2001 |
| JP | 2002-184291 | 6/2002 |
| JP | 2006-185731 | 7/2006 |

* cited by examiner

*Primary Examiner*—Anh T Mai
*Assistant Examiner*—Bernard Rojas
(74) *Attorney, Agent, or Firm*—Staas & Halsey LLP

(57) ABSTRACT

An electromagnetic relay includes a base, an electromagnet unit, a movable piece movable due to a function of the electromagnet unit, a card that is supported by the base so as to swing freely and is swung by the movable piece, and a contact structure that is opened and closed by swinging of the card, the card and the base respectively having protrusions and holes so that the protrusions fit into the holes to enable the card to swing freely.

7 Claims, 11 Drawing Sheets

ELECTROMAGNETIC RELAY

BACKGROUND OF THE INVENTION

1. Field of the Invention

The present invention generally relates to an electromagnetic relay.

2. Description of the Related Art

Conventionally, it is known as electromagnetic relays having movable and stationary contact segments, and a card that moves the movable segment to connect it to the stationary segment and disconnect it therefrom due to the function of an electromagnet unit.

Japanese Patent Application Publication Nos. 2002-184291 (hereinafter described as Document 1), 2006-185731 (hereinafter described as Document 2), and 2001-216880 (hereinafter described as Document 3) disclose that cards employed in electromagnetic relays as mentioned above are supported by a bases capable of swinging freely.

The supporting structures of the cards in the electromagnetic relays are realized by engaging shafts with bearings having a groove or cutout shape formed on the bases.

Document 1 discloses a structure that a movable segment pushes a card against a base in order to prevent displacement of the card. However, the movable segment is swung by the function of an electromagnetic unit. Thus, the card may have a play at a position of the movable segment at which the card is not pushed against the base portion sufficiently.

Document 2 discloses a structure that a rotating shaft formed in a card is inserted in a supporting portion formed in a base. Since the supporting portion has a cutout shape, the rotating axis cannot be maintained reliably. Document 3 discloses a structure similar to that disclosed in Document 2.

In short, the structures proposed in the above application publications have a problem that the card portions have a play and may come off. Particularly, when the card moves greatly, the above problem is serious.

SUMMARY OF THE INVENTION

The present invention has been made in view of the above-mentioned circumstances and provides an electromagnetic relay that can operate stably even when a card moves greatly.

According to an aspect of the present invention, there is provided an electromagnetic relay including a base, an electromagnet unit, a movable piece movable due to a function of the electromagnet unit, a card that is supported by the base so as to swing freely and is swung by the movable piece, and a contact structure that is opened and closed by swinging of the card, the card and the base respectively having protrusions and holes so that the protrusions fit into the holes to enable the card to swing freely.

DESCRIPTION OF THE PREFERRED EMBODIMENTS

A description will now be given of embodiments of the present invention with reference to the accompanying drawings.

Figure 1:
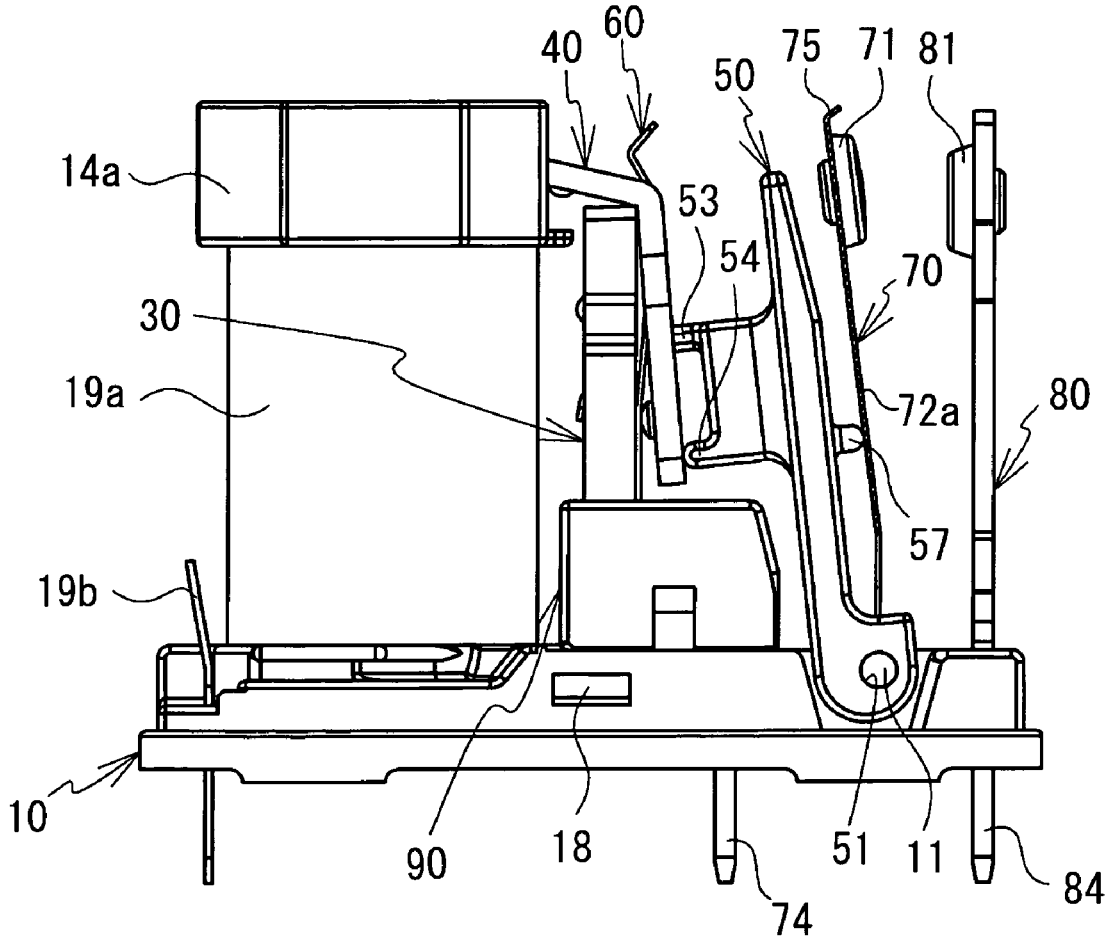
FIG. 1 is a side view of an electromagnetic relay in accordance with an embodiment of the present invention.
Figure 2:
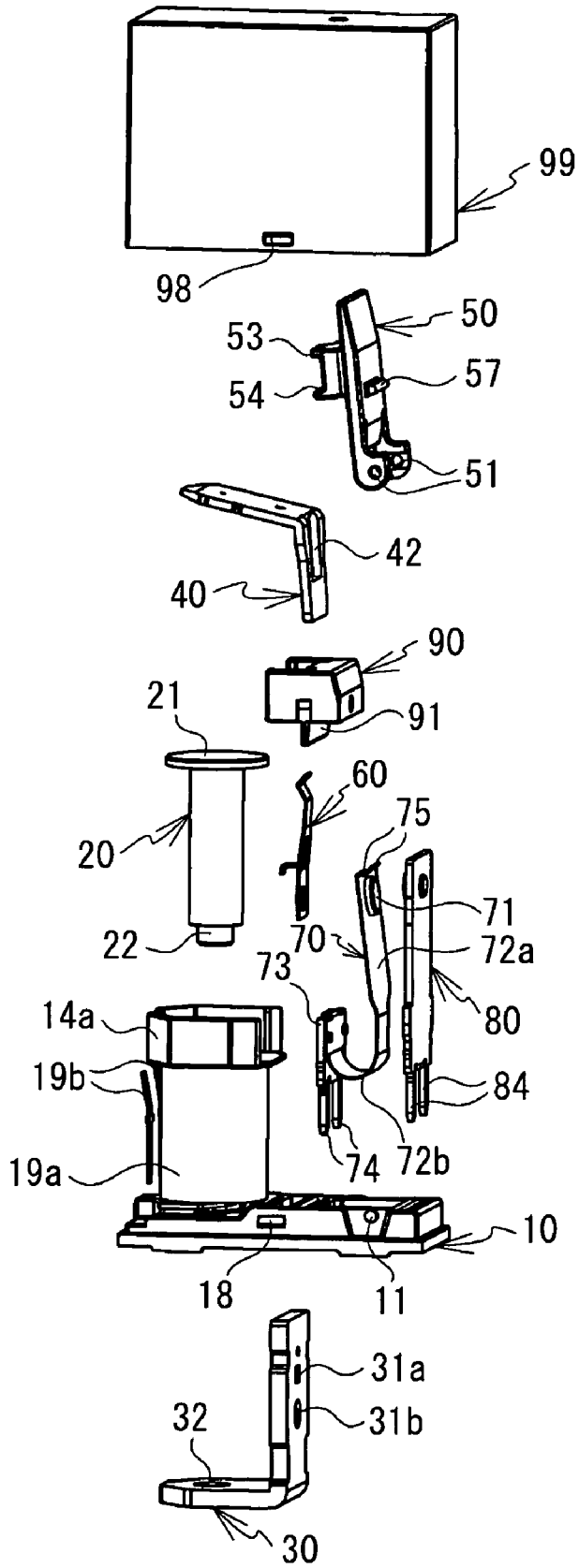
FIG. 2 is an exploded perspective view of the electromagnetic relay.
Figure 3:
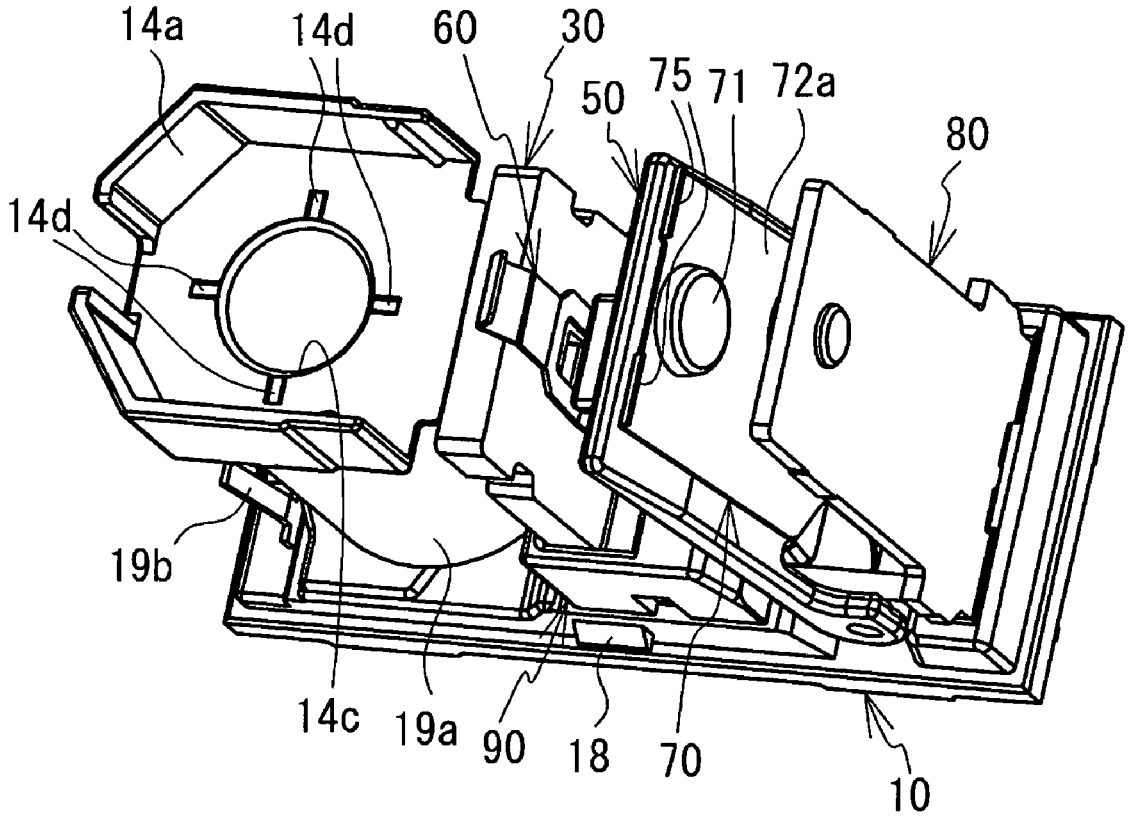
FIG. 3 is a bird's-eye view of the electromagnetic relay.

Referring to FIGS. 1 through 3, an electromagnetic relay in accordance with an embodiment of the present invention will be described. In FIG. 3, an iron core 20 and a movable iron piece 40 are omitted for the sake of simplicity.

Referring to FIGS. 1 and 2, the electromagnetic relay is composed of a base 10, the iron core 20, a yoke 30, the movable iron piece 40, a card 50, a hinge spring 60, a movable contact segment 70, a stationary contact segment 80, an insulating cover 90, and a case 99.

The base 10 may be made of synthetic resin and may be integrally formed with a spool 14*b*. A coil 19*a* for magnetizing is wound around the spool 14*b*. Both ends of the coil 19*a* are wound around coil terminals 19*b*.

A guide wall 14*a* is provided on the top of the spool 14*b*, and guides operation of the movable iron piece 40. Referring to FIG. 3, the guide wall 14*a* has an opening 14*c* for inserting the iron core 20. There are provided vents 14*d* located at four positions around the opening 14*c*.

The iron core 20 has a column shape and may be made of ferrite. The iron core 20 is magnetized when a current is supplied to the coil 19*a*. The iron core 20 is inserted into the opening 14*c* and a bottom part 22 thereof fits into a hole 32 of the yoke 30.

The yoke 30, which is connected to the iron core 20, supports the movable iron piece 40 to move freely with the hinge spring 60. The electromagnet unit is mainly composed of the coil 19*a*, the iron core 20 and the yoke 30.

The movable iron piece 40 is formed into an L shape and is supported by the yoke 30 so that a valley portion of the L shape functions as a fulcrum. The movable iron piece 40 is moved by the function of the electromagnet unit so that the card 50 can swing.

The card 50 is attached to the base 10 so as to swing freely. This may be achieved by holes 51 provided on the both sides of the card 50, and protrusions 11 formed on the both sides of the base 10. Referring to FIG. 1, the card 50 has a first pushing portion 54 and a second pushing portion 57 on opposite sides of the card 50. The first pushing portion 54 touches the movable iron piece 40, and the second pushing portion 57 touches the movable contact segment 70. Further, the card 50 has a fitting protrusion piece 53 (fitting part on the card side) provided above the first pushing portion 54, which is freely engaged with a long hole 42 formed in the movable iron piece 40.

The hinge spring 60 is provided to be penetrated through the long hole 42 (fitting part on the movable portion side) to allows the movable iron piece 40 to move against the yoke 30.

The movable and the stationary contact segments 70 and 80 compose a contact structure which is opened and closed by swinging of the card 50, and have a movable contact 71 and a stationary contact 81 in the upper parts thereof respectively. The movable and the stationary contact segments 70 and 80 are made of an electrically conductive material. The movable contact segment 70 will be described in detail later.

The stationary contact segment 80 has a plate shape, and has a terminal portion 84 in the bottom part. The segment 80 is supported by inserting it into an insertion portion 15*a* (FIG. 5) provided on the base 10.

The insulating cover 90 covers an upper portion of a terminal plate 73 projected from the top surface of the base 10. The case 99 houses the parts of the electromagnetic relay, and has a fixing hole 98, which fits into a fixing protrusion 18 formed on the base 10.

Next, a description will be given of an operation of the electromagnetic relay with reference to the accompanying drawings.

When current is supplied to the coil 19*a*, magnetic suction is generated between the movable iron piece 40 and an upper portion 21 provided on the iron core 20 by the function of the electromagnet unit. Thus, the movable iron piece 40 can be brought into contact with the upper portion 21. Thus, the movable iron piece 40 is rotated counterclockwise in FIG. 1 about the bent portion of the movable iron piece 40. This movement causes the first pushing portion 54 to be pushed to rotate the card 50 in the clockwise direction in FIG. 1 about the protrusions 11. Then, the second pushing portion 57 pushes the backside of the movable contact segment 70, which is thus pushed rightwards. Thus, the movable contact 71 is brought into contact with the stationary contact 81.

In contrast, when current is cut off, the hinge spring 60 urges the movable iron piece 40, which goes back to the initial position in FIG. 1. This movement causes the card 50 to move counterclockwise, and the movable contact 71 and the stationary contact 81 move away from each other due to the spring function of the movable contact segment 70.

Now, an assembling procedure of the electromagnetic relay will be described.

First, the coil terminals 19*b* are pushed into a hole for the coil terminal formed on the base 10. Next, the coil 19*a* is wound around the spool 14*b*. Then, the iron core 20 is inserted into the opening 14*c*, and the yoke 30 is inserted in the base 10 from the bottom side, so that the bottom part 22 of the iron core 20 can be fitted into the hole 32.

After that, the hinge spring 60 is attached to the yoke 30. Then, both ends of the coil 19*a* are wound around the coil terminals 19*b*, respectively. Then, the stationary and movable contact segments 80 and 70 are pushed into the insertion portions 15*a* and 15*c*, respectively, so that the respective terminal portions 84 and 74 project from the bottom side of the base 10. Thereafter, the insulating cover 90 is attached to the terminal plate 73, and the movable iron piece 40 is attached to the yoke 30 via the hinge spring 60. And the card 50 is fixed to the base 10 so that the protrusions 11 fit into the holes 51. Then, a sealing agent is applied to the yoke 30 exposed from the bottom side of the base 10 and the bottom part 22. Finally, the fixing protrusion 18 fits into the fixing hole 98, and the electromagnetic relay is completed.

The card 50 will now be described in detail with reference to FIGS. 4 through 6 in which some parts are omitted for the sake of simplicity.

Figure 4:
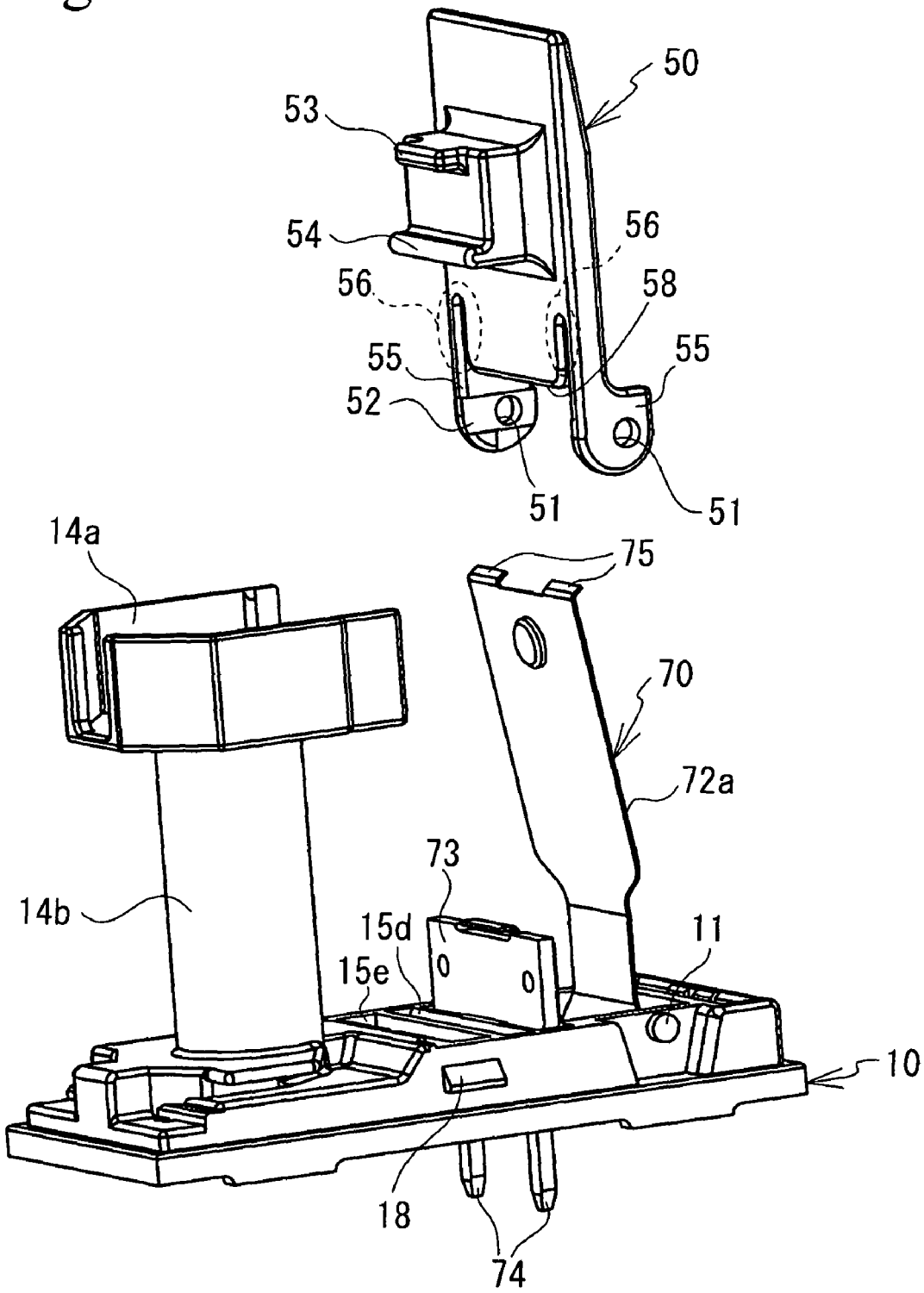
FIG. 4 is a perspective view of the electromagnetic relay seen from the backside thereof prior to attachment of a card.
Figure 5:
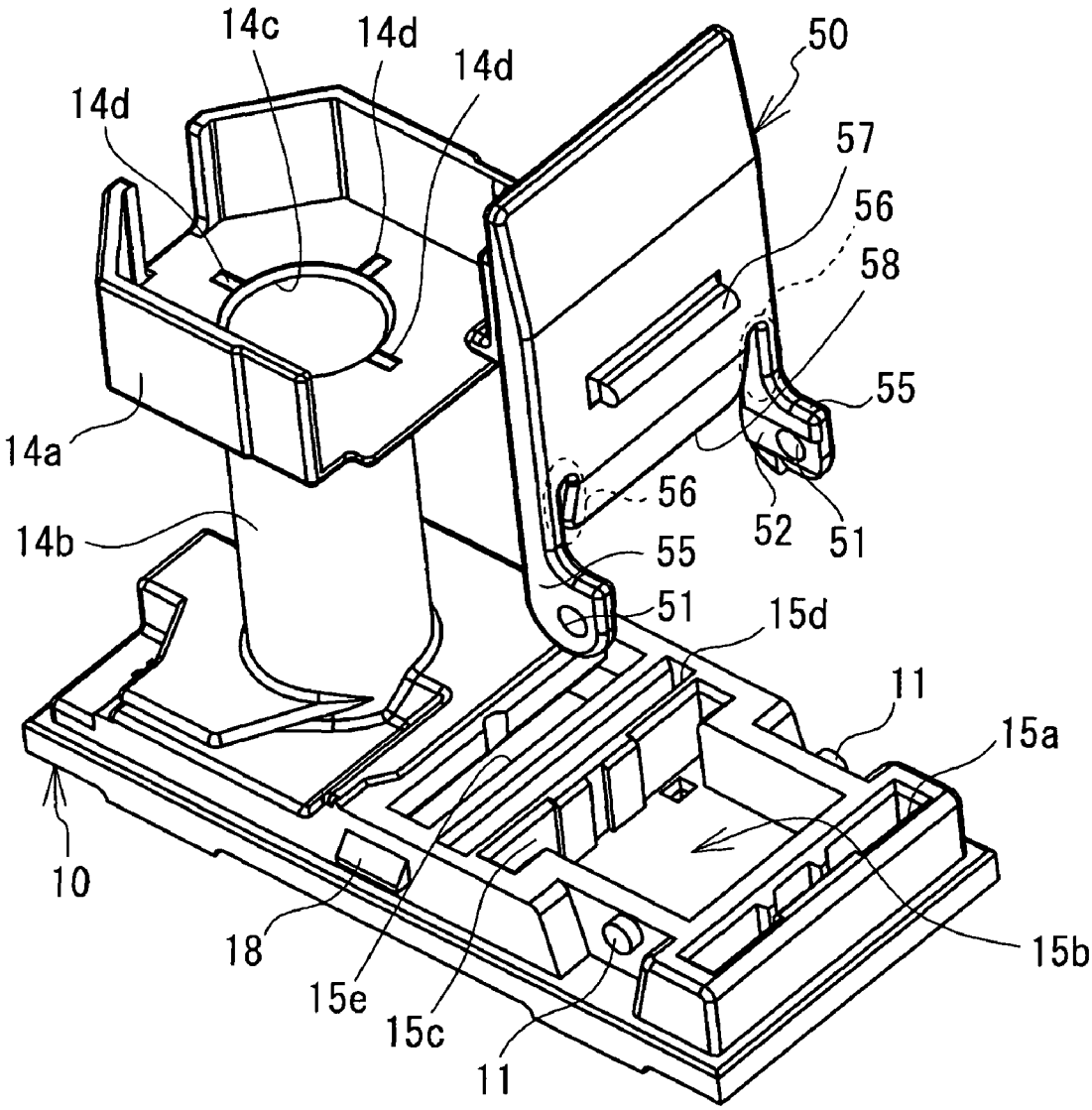
FIG. 5 is a bird's-eye view of the electromagnetic relay seen from the upper side thereof prior to attachment of the card.

As shown in FIGS. 4 and 5, the card 50 is pushed against the base 10 so that the protrusions 11 can fit into the holes 51. Thus, the card 50 is attached to the base 10 as shown in FIG. 6.

The card 50 is supported by the base 10 so as to move freely by fitting the protrusions 11 into the holes 51. The card 50 is thus capable of swinging stably. This structure is quite different from the conventional electromagnetic relay in which the shafts engage the bearings formed by a groove or a cutout portion.

Figure 6:
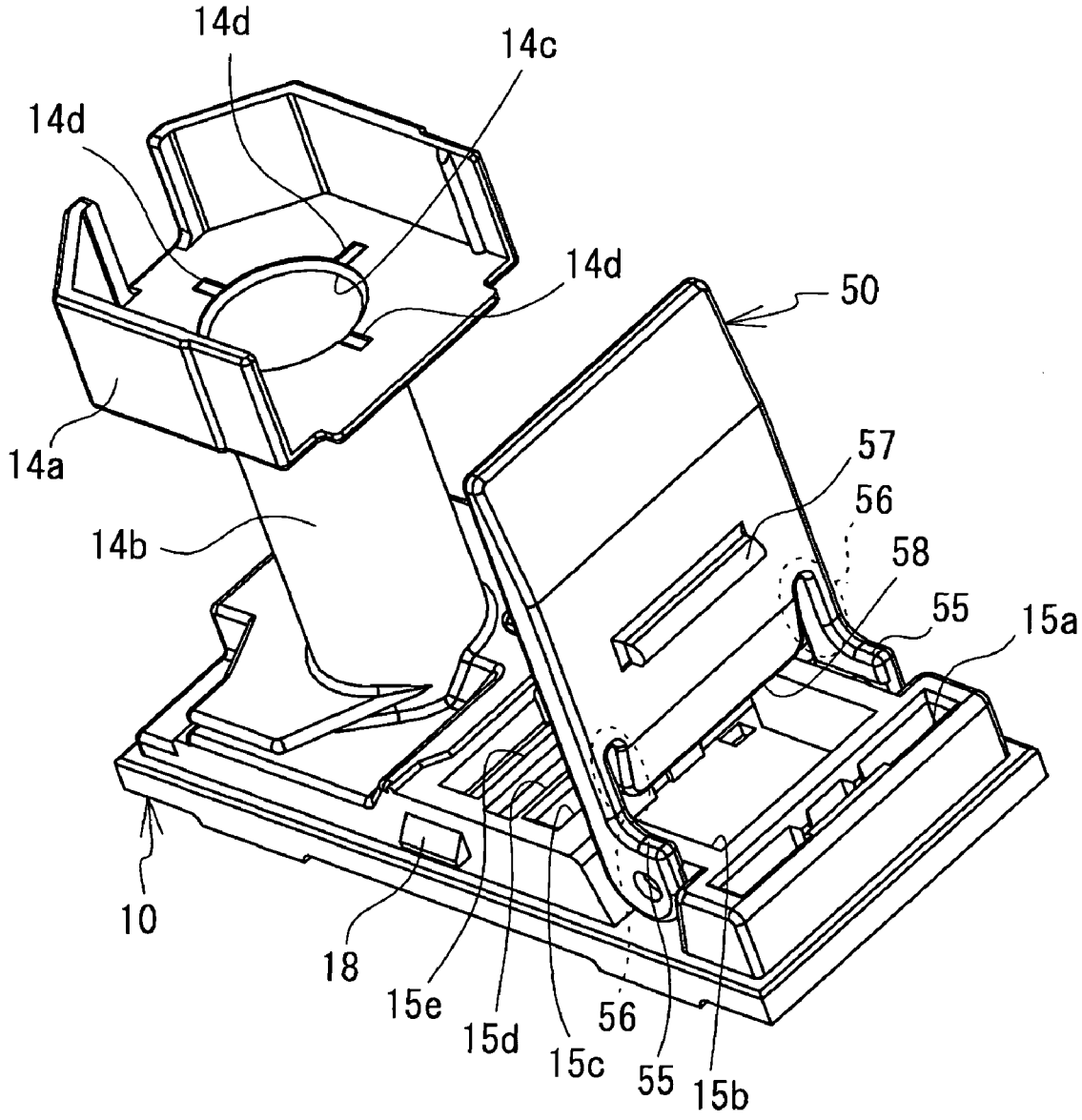
FIG. 6 is a bird's-eye view of the electromagnetic relay seen from the upper side thereof after the card is attached.

As shown in FIGS. 4 through 6, the holes 51 are respectively formed in a pair of arm portions 55 extending downwards so as to form the cutout portion 58. A pair of slits 56 is formed between the arm portions 55 and the cutout portion 58. This configuration enables the pair of arm portions 55 to elastically extend outward so that the protrusions 11 can be fitted into the holes 51.

As shown in FIGS. 4 and 5, there are sliding parts 52 that are formed around the hole 51 and are thinner than the other parts in order to enable the card 50 to move more smoothly.

Next, a description is given of a play restraining structure that restrains play between the card 50 and the movable iron piece 40.

The fitting protrusion piece 53 fits into the long hole 42 loosely as shown in FIG. 2.

Referring to FIG. 4, the fitting protrusion piece 53 is formed so as to be shorter than the first pushing portion 54 in the width direction of the card 50. As shown in FIG. 2, the long hole 42 is formed along the longitudinal direction so as to face the card 50. The long hole 42 and the fitting protrusion piece 53 engage with each other so that the movable iron piece 40 and the card 50 can swing.

In other words, the fitting protrusion piece 53 moves in the longitudinal direction of the long hole 42 by the swing of the movable iron piece 40 and the card 50, and the long hole 42 is formed to allow this movement of the fitting protrusion piece 53. In contrast, in the short-hand direction of the long hole 42, that is the width direction of the card 50 and the movable iron piece 40, the fitting protrusion piece 53 is formed so as to be slightly smaller than an inside width of the long hole 42. It is thus possible to restrain the play of the movable iron piece 40 against the card 50 in the width direction. This makes it possible to stably transmit the swing of the movable iron piece 40 to the card 50, and to restrain a noisy sound resulting from the swing.

Since the hinge spring 60 is penetrated through the long hole 42, the movable iron piece 40 is supported by the yoke 30 to swing freely. It is thus not necessary to form another fitting portion to fit the fitting protrusion piece 53 against the movable iron piece 40, so that the movable iron piece 40 can be simplified, and a movable segment used in the conventional electromagnetic relay can be employed as it is.

Figure 7:
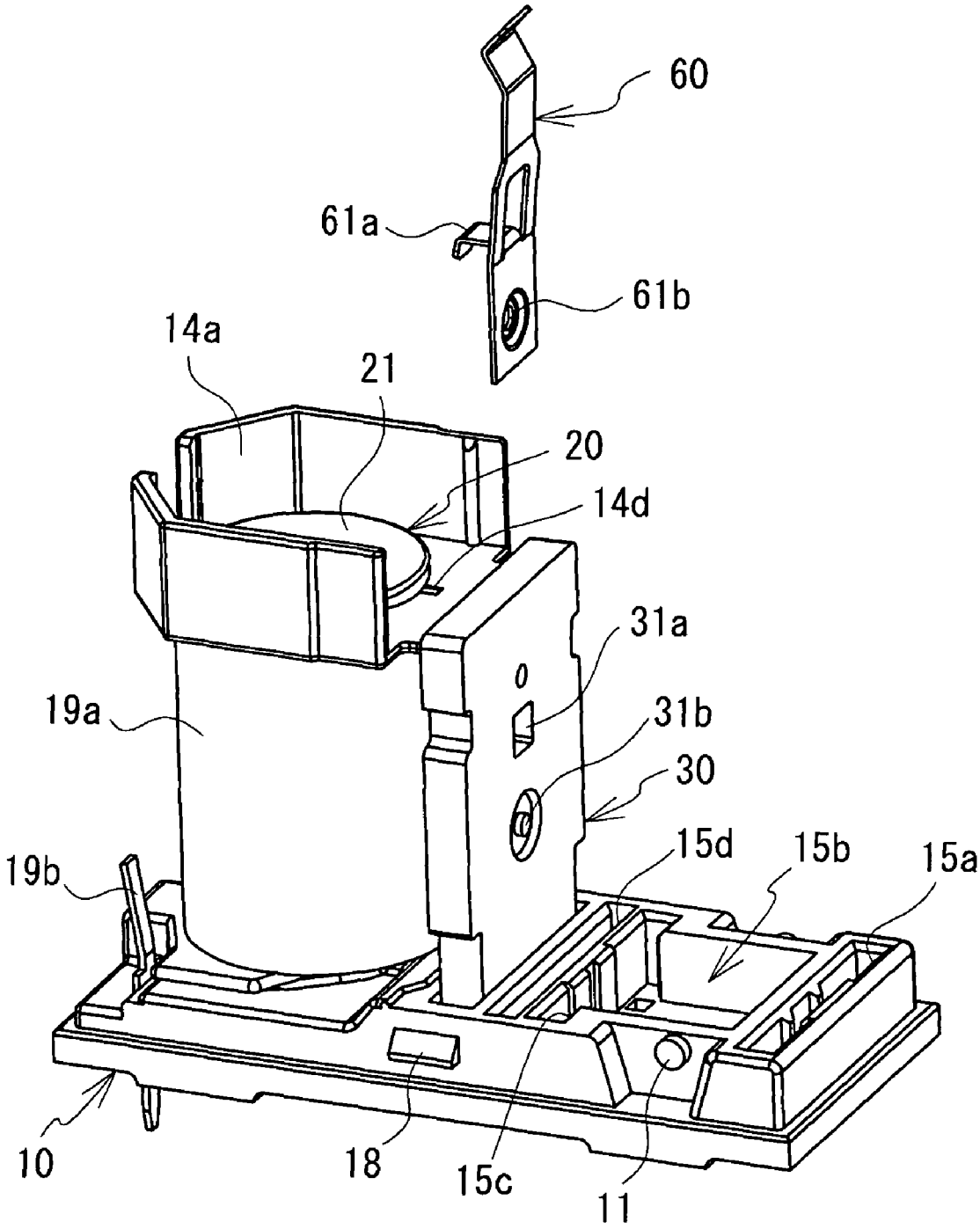
FIG. 7 is a perspective view of the electromagnetic relay seen before a hinge spring 60 is attached to a yoke.
Figure 8:
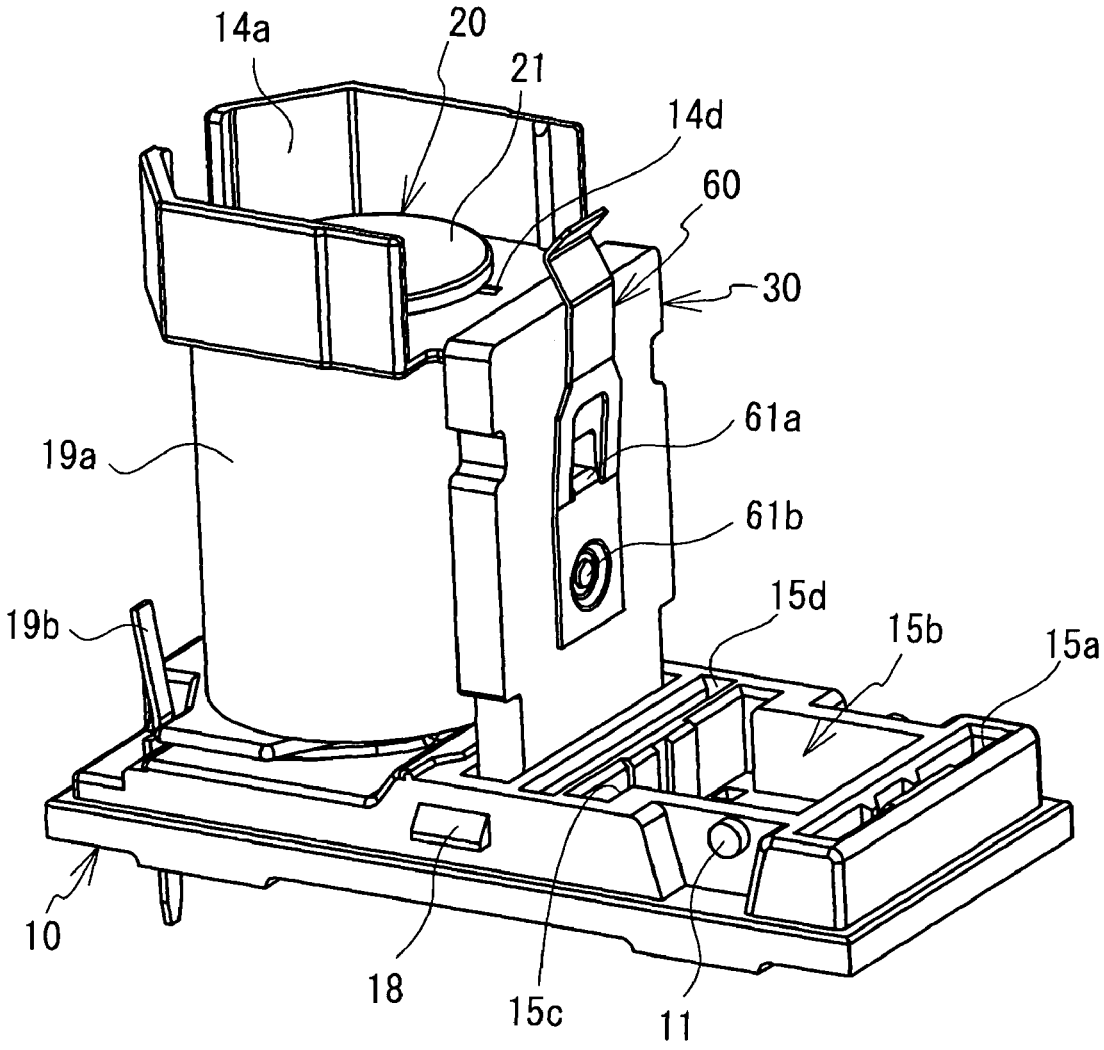
FIG. 8 is a perspective view of the electromagnetic relay seen after the the hinge spring is attached to the yoke.

A description is given of assembling the yoke 30 and the hinge spring 60 with reference to FIGS. 7 and 8.

First, the upper part of the yoke 30 is pushed into an insertion portion 15*e*, which is shown in FIGS. 4 through 6, from the bottom part of the base 10 so as to be penetrated through the insertion portion 15*e*. Next, the iron core 20 is inserted into the opening 14*c* and the bottom part 22 of the iron core 20 is fitted into the hole 32. FIG. 7 shows a state of the above.

Referring to FIG. 7, the yoke 30 has a hole 31*a* (fitting part on the yoke side) formed at the center of the yoke 30 in a square shape and a protrusion 31*b* (fitting part on the yoke side) formed at a position lower than the hole 31*a* and on a surface facing the stationary contact segment 80.

The hinge spring 60 has a tongue-shaped piece 61*a* (a fitting part on the hinge spring side) and a hole 61*b* (another fitting part on the hinge spring side), which are positioned so as to correspond to the hole 31*a* and the protrusion 31*b*, respectively. The tongue-shaped piece 61*a* is formed by punching a part of the hinge spring 60 and folding the part two times to form a substantially C-shaped structure. The hole 61*b* is similarly formed by punching.

It is easy to attach the hinge spring 60 to the yoke 30 by pushing the tongue-shaped piece 61*a* and the hole 61*b* into the hole 31*a* and the protrusion 31*b*, respectively. It is thus possible to assemble the hinge spring and the yoke in short time without using staking or welding so that the assembling procedure can be improved.

Figure 9:
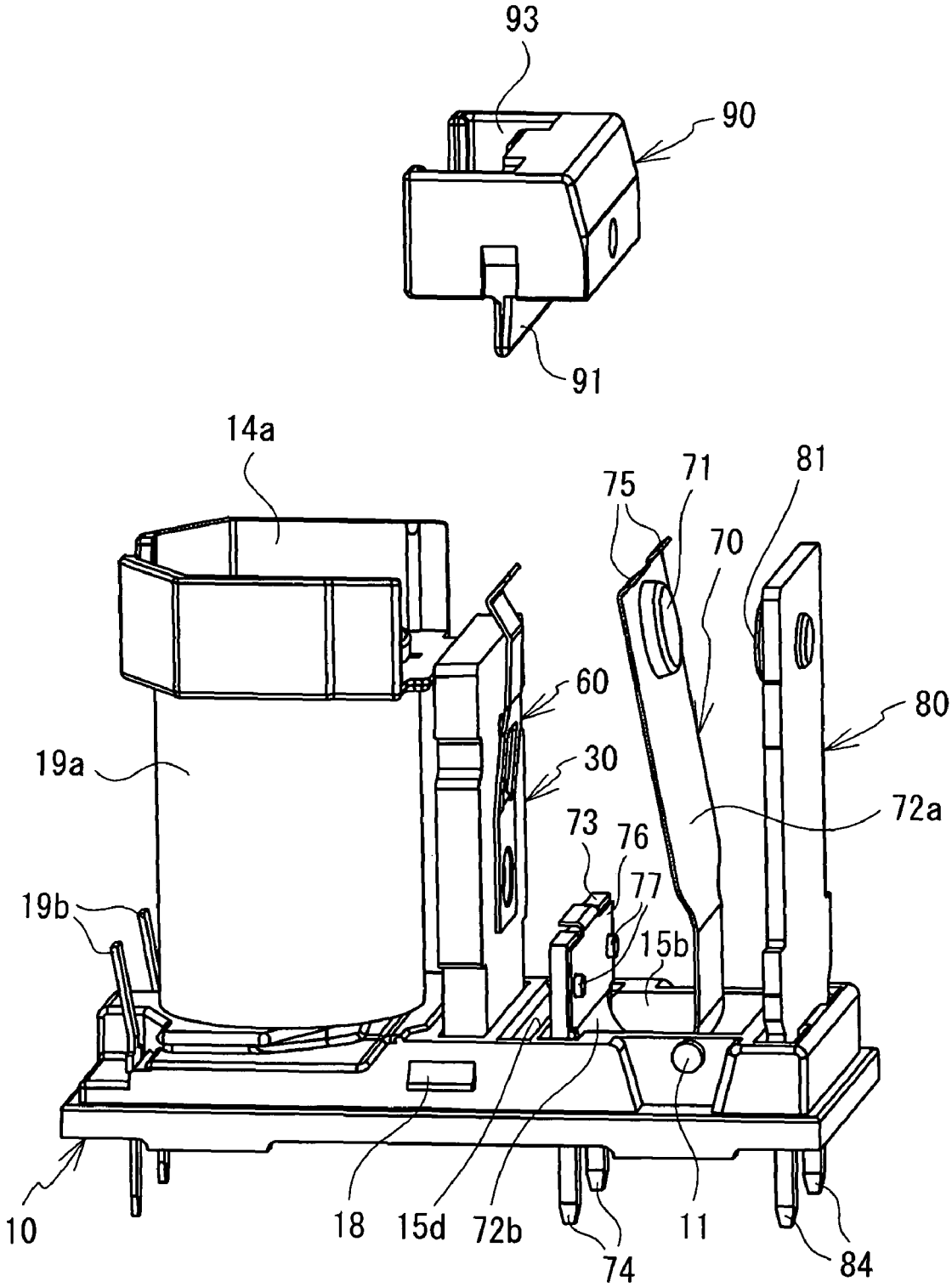
FIG. 9 is a perspective view of the electromagnetic relay for explaining a movable contact segment and an insulating cover.

Next, the movable contact segment 70 is described by referring to FIG. 9.

The movable contact segment 70 has a facing portion 72*a* that faces the stationary contact segment 80 from the upper part, and a curved portion 72*b*, which is a part of the facing portion 72*a* and is warped so as to be apart from the stationary contact segment 80 as it becomes close to the base 10 (the bottom side) and is curved upward again. The facing portion 72*a* and the curved portion 72*b* may be made of an elastically transformable thin board and formed in a J shape. The curved portion 72*b* has the terminal plate 73 at the end, which is made thicker than the curved portion 72*b* and has the terminal portion 74 at the bottom. The terminal plate 73 is supported by penetrating into an insertion portion 15*d*.

As shown in FIG. 9, the terminal plate 73 has a plate portion 76, which is electrically conductive, and forms a part of the movable contact segment 70. The terminal plate 73 has two protrusions 77, which are fitted into holes formed on opposite sides of the plate portion 76 and the curved portion 72*b*.

First, the protrusions 77 are fitted into the holes provided on the opposite sides of the curved portion 72*b*, then the plate portion 76 is fixed to the terminal plate 73 in order to fit the protrusions 77 into the holes of the plate portion 76. After that, the protrusions 77 are fixed by staking so that the curved portion 72*b* and the terminal plate 73 are fixed, and the movable contact segment 70 is completed.

The movable contact segment 70 has the curved portion 72*b* that is elastically transformable, it is thus possible to reduce the bending stress of the movable contact segment 70 necessary to become close to and apart from the stationary contact segment 80. The above allows that the movable contact segment 70 can become close to and apart from the stationary contact segment 80 even when the voltage supplied in the coil 19*a* is low. It is thus possible to reduce the bending stress of the movable contact segment 70. Thus, the residual stress to the movable contact segment 70 can be restrained and fatigue breakdown can be restrained.

The curved portion 72*b* is warped so as to be apart from the stationary contact segment 80. It is thus possible to secure a certain distance between the terminal portion 74 and the terminal portion 84. The above makes it easy to assemble the electromagnetic relay to a substrate by handwork.

As shown in FIGS. 5 through 8, the base 10 has a hollow 15*b*, which houses the curved portion 72*b* to allow transformation caused by the movement of the movable contact segment 70. The insert portion 15*c* is a part of the hollow 15*b*.

Next, a description upon an arrangement of the card 50 will be given with reference to the accompanying drawings.

The card 50 is arranged between the facing portion 72*a* and the terminal plate 73 as shown in FIG. 4. Referring to FIGS. 4 through 6, the cutout portion 58 is formed so that the curved portion 72*b* can be accommodated in a space between the holes 51 of the card 50. The above allows the card 50 to be arranged between the facing portion 72*a* and the terminal plate 73 without interference of the card 50 and the curved portion 72*b*.

The card 50 is capable of securing the insulated condition between the facing portion 72*a* of the movable contact segment 70 and the yoke 30. Further, a dead space can be omitted and the electromagnetic relay can be downsized.

Figure 10:
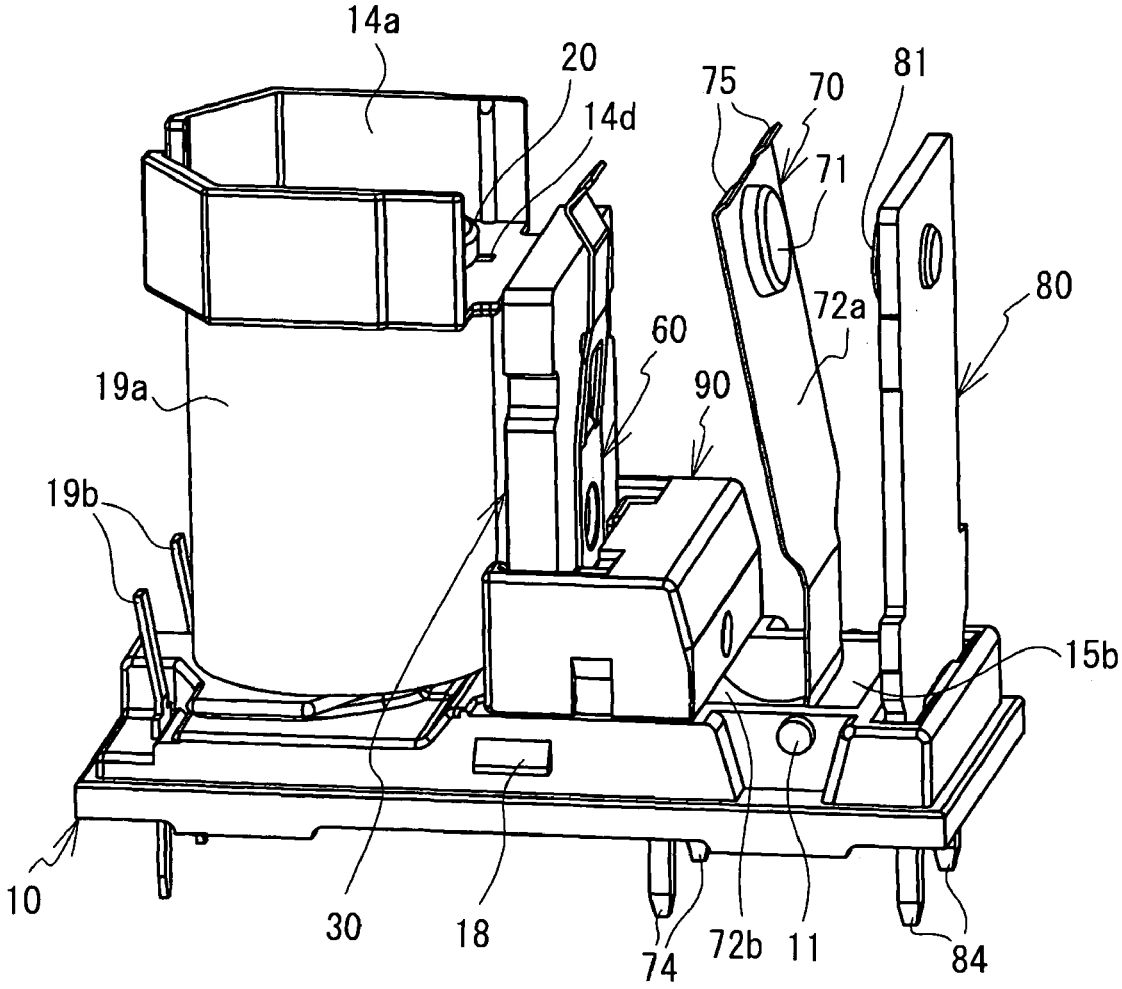
FIG. 10 is a perspective view of the electromagnetic relay after the insulating cover is attached to a base.

Now, a description is given of the insulating cover 90 with reference to FIGS. 9 and 10.

FIG. 10 shows the electromagnetic relay with the insulating cover 90 being attached. The insulating cover 90 made of an insulating material has an insertion piece 91 projecting from the bottom, and a cutout portion 93 on the top surface as shown in FIG. 9. The inside of the insulating cover 90 is formed so as to cover the protrusion portion of the terminal plate 73 projecting from the top surface of the base 10.

The insulating cover 90 is attached to the base 10 by inserting the insertion piece 91 into the insertion portion 15*d*. And the insulating cover 90 is a part of partition between the terminal plate 73 and the base 10. The cutout portion 93 is formed so as to surround the yoke 30 and cover not only the surface facing the terminal plate 73 but the side surface of the yoke 30 as shown in FIG. 10.

The above secures insulation between the terminal plate 73 and the yoke 30. Thus, even when the terminal plate 73 becomes close to the yoke 30, sufficient insulation can be secured and the electromagnetic relay can be downsized.

The vents 14*d* will now be described by referring to FIG. 11.

A bottom side 33 of the yoke 30 and the bottom part 22 are formed so that the bottom side of the base 10 is exposed. The sealing glaze, which may be liquid and thermosetting, is plastered over the exposed part and is then heated in order to secure the connection of the yoke 30 and the iron core 20.

Figure 11:
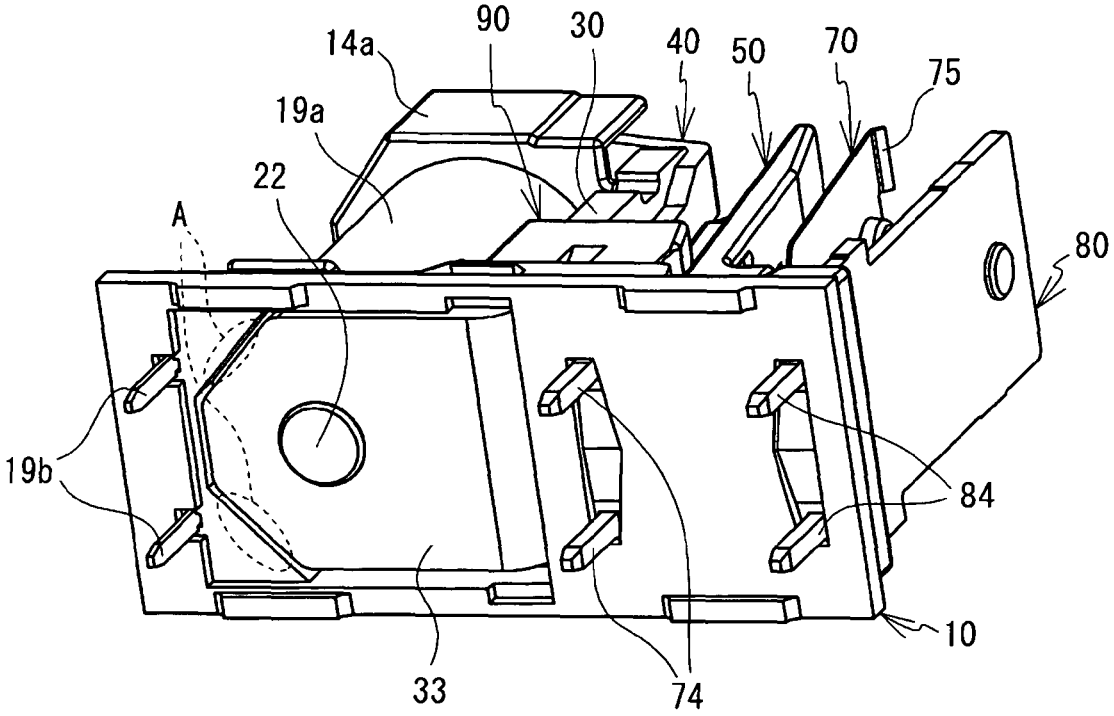
FIG. 11 is a perspective view of the electromagnetic relay seen from the bottom side thereof.

Referring to FIG. 11, the yoke 30 and the base 10 are formed so as to have gaps A, which are formed so as to communicate with the vents 14*d* via a gap between the inner circumference of the spool 14*b* and the iron core 20. The vents 14*d* are large enough so as not to be completely occupied by the upper portion 21 as shown in FIGS. 7, 8 and 10.

Conventionally, bubbles included in the sealing agent are expanded by coating and heating the coated sealing and may become pinholes after being hardened. In contrast, according to the present embodiment, the gaps A communicate with the vents 14*d*. Thus, the bubbles can escape via the vents 14*d*, and the occurrence of pinholes can be prevented.

The present invention is not limited to the specifically disclosed embodiments, but other embodiments and variations may be made without departing from the scope of the present invention.

The present application is based on Japanese Patent Application No. 2007-078940 filed Mar. 26, 2007, the entire disclosure of which is hereby incorporated by reference.

What is claimed is:

1. An electromagnetic relay comprising:

a base having a hollow formed therein;

an electromagnet unit;

a movable piece movable due to a function of the electromagnet unit;

a card that is supported by the base so as to swing freely and is swung by the movable piece, wherein the card and the base respectively have corresponding protrusions and holes so that the protrusions fit into the holes to enable the card to swing freely; and a contact structure that is opened and closed by swinging of the card, wherein the contact structure includes a stationary contact segment and a movable contact segment and the card contacts and moves the movable contact segment to contact the stationary contact segment, wherein the movable contact segment has an elastically deformable curved portion that is received in the hollow between the protrusions and has a first end and a second end, a terminal plate connected to the first end and received in the base, and a facing portion connected to the second end and having a free end which contacts the stationary contact portion, wherein the terminal plate and the facing portion extend out of the hollow in a first substantially similar direction, wherein the card is arranged between the terminal plate and the facing portion, and wherein the card has a cutout portion which receives in spaced relation the curved portion therein.

2. The electromagnetic relay as claimed in claim 1, further comprising a play restraining structure that restrains the play between the card and the movable piece.

3. The electromagnetic relay as claimed in claim 2, wherein the play restraining structure includes a first portion provided on the card and a second portion provided on the movable piece, and the first and second portions fit into each other so as to allow the card to swing and allow the movable piece to move.

4. The electromagnetic relay as claimed in claim 3, wherein:

the electromagnet unit includes a yoke connected to an iron core magnetized by supplying current to a coil for magnetizing;

the first and second portions include a protrusions and a holes respectively; and a hinge spring that biases the movable piece toward the yoke, the hinge spring penetrating into the second portion on the movable piece.

5. The electromagnetic relay as claimed in claim 1, further comprising an insulating cover that substantially covers the terminal plate projecting from a top surface of the base.

6. The electromagnetic relay as claimed in claim 1, wherein:

the movable contact segment has a bent portion that prevents an interference with the card when the card is attached to the base.

7. The electromagnetic relay as claimed in claim 1, wherein the card is elastically transformable.

* * * * *

UNITED STATES PATENT AND TRADEMARK OFFICE

CERTIFICATE OF CORRECTION

PATENT NO. : 7,859,371 B2
APPLICATION NO. : 12/078043
DATED : December 28, 2010
INVENTOR(S) : Satoshi Takano It is certified that error appears in the above-identified patent and that said Letters Patent is hereby corrected as shown below:

Col. 8;
In the Claims, claim 4, line 7, change “holes” to -- hole --.

Signed and Sealed this
Fifteenth Day of March, 2011

David J. Kappos

David J. Kappos
*Director of the United States Patent and Trademark Office*